United States Patent [19]

Meyer et al.

[11] 4,191,277

[45] Mar. 4, 1980

[54] APPARATUS FOR TRANSMITTING CONTROL SIGNALS TO ELEVATORS OR THE LIKE

[75] Inventors: Fritz Meyer, Küssnacht; Josef Heine; Ladislav Vig, both of Ebikon, all of Switzerland

[73] Assignee: Inventio AG, Hergiswil, Switzerland

[21] Appl. No.: 926,221

[22] Filed: Jul. 19, 1978

[30] Foreign Application Priority Data

Jul. 29, 1977 [CH] Switzerland ..... 9405/77

[51] Int. Cl.[2] ..... B66B 1/16

[52] U.S. Cl. ..... 187/29 R

[58] Field of Search ..... 187/29

[56] References Cited

U.S. PATENT DOCUMENTS

| | | | |
|---|---|---|---|
| 3,169,606 | 2/1965 | Thirup | 187/29 |
| 3,414,088 | 12/1968 | Bruns et al. | 187/29 |
| 4,042,067 | 8/1977 | Mandel | 187/29 |
| 4,124,102 | 11/1978 | Doane et al. | 187/29 |

*Primary Examiner*—Gene Z. Rubinson
*Assistant Examiner*—W. E. Duncanson, Jr.
*Attorney, Agent, or Firm*—Werner W. Kleeman

[57] ABSTRACT

An apparatus for transmitting control signals to a transportation installation, such as typically an elevator wherein a respective diode matrix codes the cabin and floor calls, and the outputs of which are connected by common call lines with the inputs of a call memory system. A coding device is provided for coding the elevator cabin position and comprises switches attached to the elevator cabin and actuation elements arranged in the cabin chute. An actuation element is provided for each floor change and is associated with the changing binary place of the code word associated with the floor. The switches are connected by means of a respective series connected diode of a coupling system with the outputs of the cabin diode matrix and by means of the call lines with the input of a cabin position memory. A logic circuit serves to switch the diodes of the cabin and floor diode matrixes into their non-conductive or reverse state during travel of the cabin and for a given time span following standstill thereof and to switch the diodes of the coupling system into their forward or conductive state, and to disconnect the call lines from the call memories. This logic circuit, during the remaining time of standstill of the cabin, switches the diode matrixes into their conductive or forward direction and the coupling diodes into their blocking state or reverse direction as well as connecting the call lines with the call memories.

4 Claims, 4 Drawing Figures

| Floor | Code Word For: Call Input (binary inverted) | Cabin position (Graycode) | Call Processing (binary) |
|---|---|---|---|
| I | II | III | IV |
| 15 | 0000 | 1000 | 1111 |
| 14 | 0001 | 1001 | 1110 |
| 13 | 0010 | 1011 | 1101 |
| 12 | 0011 | 1010 | 1100 |
| 11 | 0100 | 1110 | 1011 |
| 10 | 0101 | 1111 | 1010 |
| 9 | 0110 | 1101 | 1001 |
| 8 | 0111 | 1100 | 1000 |
| 7 | 1000 | 0100 | 0111 |
| 6 | 1001 | 0101 | 0110 |
| 5 | 1010 | 0111 | 0101 |
| 4 | 1011 | 0110 | 0100 |
| 3 | 1100 | 0010 | 0011 |
| 2 | 1101 | 0011 | 0010 |
| 1 | 1110 | 0001 | 0001 |
| No Call | 1111 | | 0000 |

APPARATUS FOR TRANSMITTING CONTROL SIGNALS TO ELEVATORS OR THE LIKE

BACKGROUND OF THE INVENTION

The present invention relates to a new and improved construction of transportation installation, and, more specifically relates to apparatus for transmitting control signals to transportation installations, especially in the form of elevators or the like.

In its more particular aspects the present invention relates to apparatus for transmitting control signals to elevators, wherein for the puspose of reducing the number of transmission lines the signals representative of the floor and cabin call as well as the cabin position are transmitted in coded form, there being provided memories in which there can be stored the coded floor and cabin call and the coded cabin position signals. Additionally, a comparator compares the signals representative of the floor and cabin calls with the cabin position and produces a respective control signal governing the direction of travel and stopping of the elevator cabin.

In order to save in transmission lines it is generally known in this particular field of technology to employ for relay-remote controls group selection circuits with diode matrixes. Thus, for instance, in the case of a diode matrix having ten inputs and five outputs, it is possible to transmit ten control commands which have been simultaneously infed to the inputs by means of five transmission lines connected with the outputs.

Now in U.S. Pat. No. 3,882,447 granted May 6, 1975 there is known to the art an apparatus wherein powering and controlling of the floor lamps and the lamps of the elevator cabin or car position display of an elevator system is accomplished by means of a diode matrix. The rows or lines of the matrix are correlated to the up service lamps and down service lamps and the cabin position lamps, whereas the columns of the matrix are correlated to the individual floors. The lamps are connected in series with the relevant diodes which bridge the cross-over or intersection points of the matrix. Each row and each column has a transistor switching circuit which can be switched by means of a control signal and by means of which there can be switched the lamps.

Although with this apparatus it is possible to save or wiring and switching circuits due to the employment of the diode matrix, nonetheless the prevailing equipment expenditure is still quite considerable in view of the relatively complicated transistor switching circuits, and therefore, cannot be tolerated for elevator controls which should be less expensive.

According to another state-of-the-art control apparatus as taught in the French Pat. No. 1,562,779 the floor and cabin call signals as well as the cabin position signal are transmitted in a coded form. For this purpose there are provided two diode matrixes. One of the diode matrixes is used to form the cabin call information, whereas the other is employed to form the floor and cabin position information. Binary techniques are used for coding. All information which is present in the form of coded words are transmitted over common lines or conductors and stored in memories or storages. Logical switching circuits prevent the simultaneous transmission of the information. Thus, the formation, transmission and storage of the cabin position information only is accomplished during travel of the elevator car or cabin, and the input of floor and cabin call signals is blocked. The formation, transmission and storage of the floor and cabin call signals is only possible during stoppage of the elevator cabin, and at the same time there is blocked the input of the cabin position. The information stored in the cabin and floor call memories are compared in a comparator with the information stored in the cabin position memories and the result is infed to a drive control.

With the previously discussed control apparatus there is realized a certain saving in the transmission lines or conductors, which, however, it still not adequate for elevator systems which should be of low cost. A further drawback particularly arises from the use of only one single diode matrix for the floor call and the cabin position. This requires, apart from additional lines or conductors, an appreciable expenditure in logic circuits for the mutual blocking of the input. Additionally, for the input of the cabin position there is required at the chute or shaft for each floor a switch, this resulting in an additional increased cost of the elevator system. A further drawback resides in the fact that with power failure it is not possible to ascertain the elevator cabin position, which, in turn, requires that there be accomplished a correction travel to the next floor of the building.

In Austrian Pat. No. 249,923, there is disclosed a control apparatus for elevators wherein the cabin position can be transmitted in a coded fashion without using a diode matrix. In this system there is mounted at the elevator cabin a four-place or four-position optical or magnetic scanning device which coacts with diaphragms mounted in the elevator chute or shaft. The diaphragms which are mounted at the height of the relevant floor are arranged, as concerns number and sequence, in accordance with the binary code used for coding purposes. So that there is not present any switching point differences there is provided for each floor an additional, shorter diaphragm which frees the evaluation of the remaining diaphragms. The resultant large number of diaphragms which are required for this system constitute an appreciable drawback of such control apparatus. A further shortcoming is that after power failure the cabin position no longer is known so that here also there must be accomplished a correction travel of the elevator to the next floor or storey.

SUMMARY OF THE INVENTION

Hence, with the foregoing in mind it is a primary object of the present invention to provide a new and improved construction of apparatus for transmitting control signals or the like to transportation systems, typically elevators, in a manner not associated with the aforementioned drawbacks and limitations of the prior art proposals.

Still another and more specific object of the present invention aims at the provision of a new and improved construction of apparatus for transmitting control signals to elevators, avoiding the drawbacks of the previously discussed state-of-the-art systems, while combining and conjointly utilizing their advantages, and particularly reducing to a minimum the number of lines or conductors needed for information transmission.

Yet a further significant object of the present invention aims at providing a new and improved construction of apparatus for transmitting control signals to a transportation installation such as an elevator, in an extremely simple, reliable and accurate fashion, while reducing the requirement for information transmission lines or conductors to a minimum, and which apparatus is relatively simple in construction and design, economical to manufacture, requires a minimum of maintenance and servicing and is not readily subject to malfunction or breakdown.

Now in order to implement these and still further objects of the invention, which will become more readily apparent as the description proceeds, the apparatus of the present development is manifested by the features that a respective diode matrix is provided for coding the respective cabin and floor call signals, and the outputs of which are connected by means of common call lines or conductors with the inputs of the call memories or storages. A coding device is provided for coding the elevator cabin or car position. This coding device comprises switches attached to the elevator cabin and actuation elements arranged at the elevator cabin chute or shaft. The cabin position code is a reflected or Gray code and for each floor change there is provided an actuation element which, in each case, is correlated to the changing binary place or position of the code word associated with the floors. The switches are connected by means of a respective diode connected in series therewith of a coupling system or device with the outputs of the elevator cabin diode matrix and by means of the call lines or conductors with the inputs of a position memory. Further, there is provided a logic switching circuit by means of which, during travel of the elevator cabin or car and for a certain time span after stoppage of the elevator cabin, the diodes of the cabin and floor diode matrixes are switched into their blocking or reverse direction and the diodes of the coupling system into their forward direction, and the call lines are disconnected from the call memories or storages and during the remaining time of stoppage of the elevator cabin the diode matrixes are switched into their forward direction and the coupling diodes in their reverse direction, and the call lines are connected with the call memories.

In accordance with a preferred exemplary embodiment the logic switching circuit comprises four NOR-gates or elements having two inputs, by means of which the call lines or conductors can be disconnected from the call memories or storages and the first inputs of which are connected by means of the call lines or conductors with the outputs of the cabin and floor diode matrixes and the outputs of which are connected with the first inputs of the call memories. Further, there is provided a first series circuit of a first NOR-gate, a NOT-gate and a second NOR-gate, and three transistor switches. The output of the NOT-gate is connected with the second inputs of the four NOR-gates disconnecting the call lines from the call memories or storages. The input of the NOT-gate is connected with the input of the first transistor switch, the output of which is connected with the input of the second transistor switch and by means of a first supply line and the cabin call transmitters with the inputs of the cabin diode matrix. The output of the second transistor switch is connected by means of resistors and the call lines or conductors with the outputs of the cabin and floor diode matrixes. The output of the second NOR-gate of the first series circuit is connected with the input of the third transistor switch, the output of which is connected by means of a second supply line and the floor call transmitters with the inputs of the floor diode matrix. Additionally, the logic switching circuit comprises a second series circuit composed of a NOT-gate, a NOR-gate and an OR-gate, the output of which circuit is connected by means of an extinguishing line with the second inputs of the call memories or storages and the input of which is connected with the input of the first series circuit and a first input of the logic switching circuit. A further input of the NOR-gate of the second series circuit is connected with a further input of the first series circuit and a second input of the logic switching circuit, and a third input of the logic switching circuit is connected with an input of the OR-gate.

In order that the cabin position remains stored even in the event of power failure of the power supply network, and thus, to preclude any correction travel of the elevator cabin upon return of the power, a further exemplary construction of the invention contemplates that the switches attached to the elevator cabin comprise bistable magnetic switches and the actuation elements mounted at the elevator cabin chute comprise switching magnets.

According to a further advantageous construction of the invention there is provided a floor indicator or display which can be controlled by means of the code word formed by the bistable magnetic switches through the agency of the call lines serving for transmitting the calls and the cabin position.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
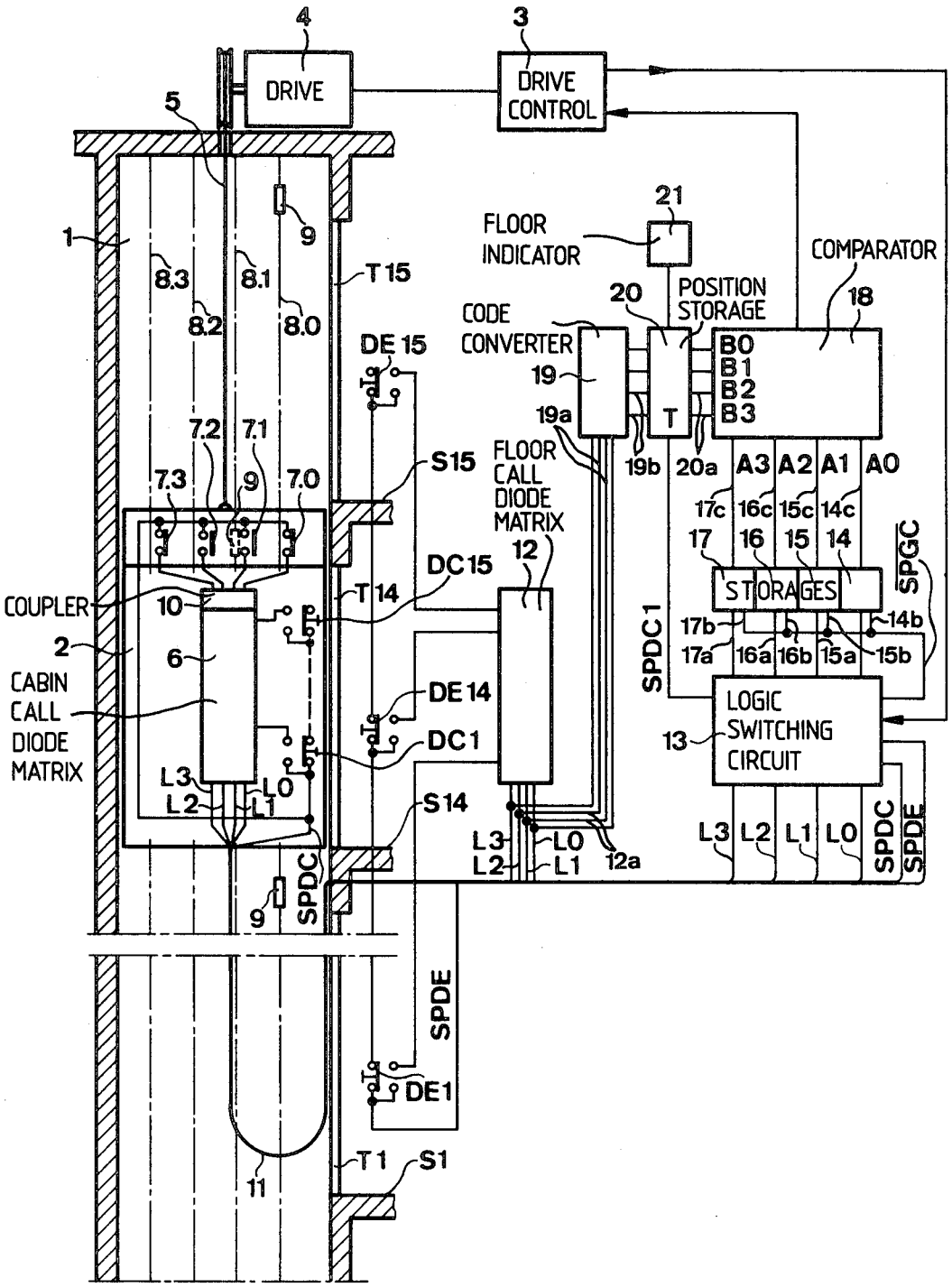
FIG. 1 is a schematic illustration of a transportation installation in the form of an elevator system having apparatus for the transmission of control signals and constructed according to the teachings of the present invention.

Describing now the drawings, it is to be understood that only enough of the structure of the elevator system has been shown in order to enable those skilled in the art to readily understand the underlying principles and concepts of the present invention. Turning attention now to FIG. 1 reference character 1 represents an only partially illustrated elevator cabin chute or shaft in which there is guided an elevator cabin or car 2. A drive or conveyor machine 4, controlled by a drive control 3, drives by means of a conveyor cable 5 the elevator cabin or car 2 which, in accordance with the selected exemplary embodiment of elevator system or installation, services 15 floors or storeys of a building, which floors have been generally designated by reference characters S1 to S15. Reference characters T1 to T15 designate the elevator chute doors arranged at the individual floors S1 to S15, respectively. Attached to the elevator car or cabin 2 is a diode matrix 5 which codes the cabin call or cabin call signal while utilizing a binary code.

The diode matrix 6, which will be discussed more fully hereinafter in the description to follow in conjunction with FIG. 2, will be seen to comprise fifteen inputs and four outputs, which have not been particularly referenced, and the inputs are connected with cabin call transmitters DC1 to DC15 which are operatively associated with the individual floors S1 to S15, respectively. The cabin call transmitters DC1 to DC15 are connected in series and are also connected with a supply line SPDC.

Arranged at the elevator cabin or car 2 are four bistable magnetic switches 7.0, 7.1, 7.2 and 7.3 of conventional construction, which move, during travel of the elevator cabin 2, along imaginary paths 8.0, 8.1, 8.2 and 8.3, respectively, which have been symbolized by dash-dot or phantom lines and which can be switched by means of switching magnets 9 located along the imaginary paths or tracks 8 and attached at the elevator chute or shaft 1. The bistable magnetic switches 7.0, 7.1 7.2 and 7.3 and the switching magnets 9 form a coding device for coding the cabin position. The coding operation is based upon a widely used code called the reflected or Gray code. The switching magnets 9 are arranged in the elevator chute or shaft 1 in accordance with the code words (FIG. 3, column III) associated with the individual floors S1 to S15. For each change of a code word there is required a switching magnet 9, so that here assuming that there are present fifteen floors, there are needed 14 switching magnets 9. The four bistable magnetic switches 7.0, 7.1, 7.2 and 7.3 are connected, on the one hand, with the supply line SPDC, and, on the other hand, by means of a coupling system or device 10, which will be described more fully in conjunction with FIG. 2, with the four outputs of the cabin diode matrix 6. Connected with these four not particularly referenced outputs of the cabin diode matrix 6 are the call lines or conductors L0, L1, L2 and L3 which are grouped together with the supply line or conductor SPDC into a hanging cable 11 and by means of which there can be transmitted both the cabin calls as well as also the cabin position to the stationary part of the elevator system.

Continuing, reference character 12 designates a stationarily mounted diode matrix which codes the floor calls while using a binary code. This diode matrix 12 has the same construction as the cabin diode matrix 6. The floor diode matrix 12 likewise possesses fifteen not particularly reference inputs and four not particularly referenced outputs, and the inputs are connected with the floor call transmitters, DE1 to DE15 associated with the individual floors or storeys S1 to S15 of the building or the like. The floor call transmitters DE1 to DE15 are connected in series and with a supply or power line SPDE. The four outputs of the floor diode matrix 12 are connected, on the one hand, by means of the call lines or conductors L0 to L3 via the hanging or suspension cable 11 with the four outputs of the cabin diode matrix 6, and on the other hand, by means of a logic switching circuit 13, to be discussed more fully hereinafter in conjunction with the description of FIG. 4, with the first inputs 14*a*, 15*a*, 16*a*, 17*a* of the four call memories or storages 14, 15, 16 and 17. The second inputs of 14*b*, 15*b*, 16*b*, 17*b* of the four call memories or storages 14 to 17 and constructed in conventional manner from an OR-gate or element and an AND-gate or element, are connected by means of an extinguishing line or conductor $\overline{\text{SPGC}}$ with the logic switching circuit 13, whereas the outputs 14*c*, 15*c*, 16*c*, 17*c* are connected with the inputs A0, A1, A2 and A3 of a comparator 18.

A code converter 19 for converting the Gray code into the binary code consists of three Exclusive-OR-gates and possesses four inputs 19*a* and four outputs 19*b*, and the inputs 19*a* are connected with the outputs 12*a* of the floor diode matrix 12. The outputs 19*b* of the code converter 19 are connected with a position storage or memory 20. Useful as the position storage 20 is a conventional 4-bit-storage (latch), the outputs 20*a* of which are connected with the inputs B0, B1, B2 and B3 of the comparator 18. The comparator 18 which will not be here further described since it functions in accordance with conventional principles, compares the call code words stored in the call memories or storages 14 to 17 with the cabin position code word stored in the position memory or storage 20 and produces a respective control signal which governs the direction of travel and stopping of the elevator cabin 2. This control signal is delivered to the drive control 3.

Reference character 21 designates a conventional floor indicator or display which displays the cabin position stored in the position memory or storage 20.

Figure 2:
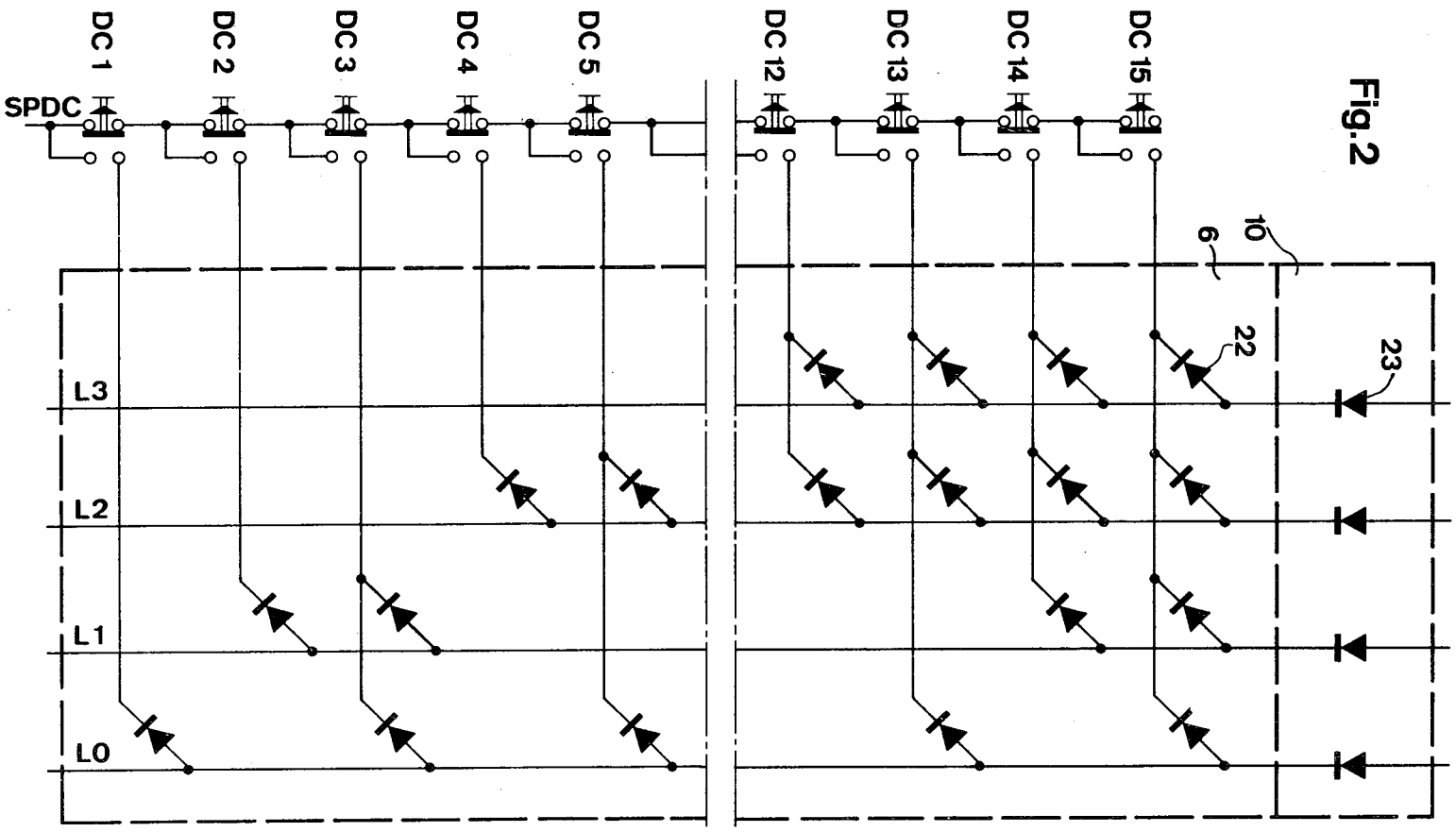
FIG. 2 illustrates a diode matrix for coding the cabin call signals.

Now in FIG. 2 reference characters DC1 to DC15, L0 to L3, SPC, 6 and 10 designate the same parts as in the arrangement of FIG. 1. The diodes 22 which are connected between the inputs and outputs of the diode matrix 6 are arranged in accordance with the code words apparent from FIG. 3, column II, and for each null position there is provided one diode 22. Thus, for instance, for the floor S15 there are arranged four diodes 22 in accordance with the code word 0000.

The coupling device or system 10 possesses four diodes 23 which are connected by means of the four bistable magnetic switches 7.0, 7.1, 7.2 and 7.3 with the four outputs of the diode matrix 6 and which prevent that during standstill of the elevator car or cabin 2 the call lines or conductors L0 to L3 will be powered by means of the magnetic switches 7.0 to 7.3.

Figures 3, 4:
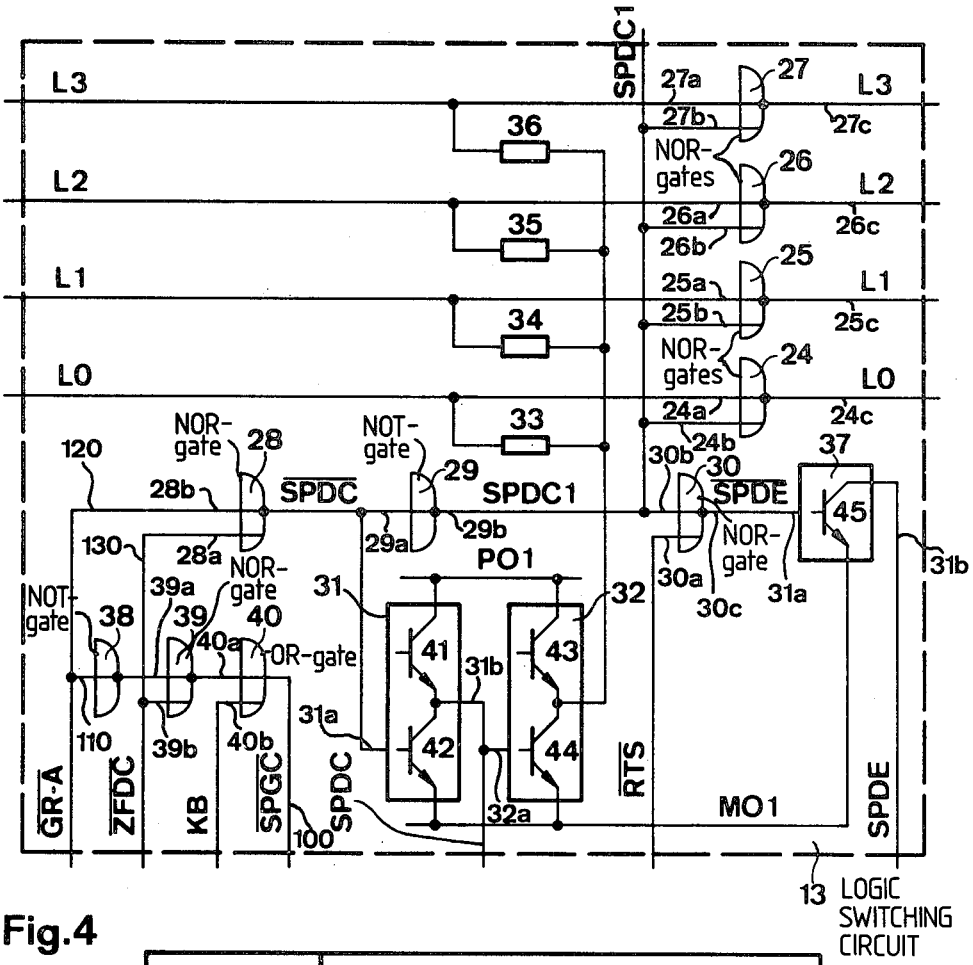
FIG. 3 illustrates a table of the code words correlated to the floors or storeys of the building.
FIG. 4 is a circuit diagram of a logic switching circuit which may be used in practicing the teachings of the present invention.

Now in FIG. 4 there are designated by reference characters 24, 25, 26 and 27 four NOR-gates or elements each having two inputs 24*a*, 24*b*, 25*a*, 25*b*, 26*a*, 26*b* and 27*a*, 27*b*, respectively, and the outputs 24*c*, 25*c*, 26*c* and 27*c*, respectively. By means of these NOR-gates 24, 25, 26 and 27 the call lines or conductors L0, L1, L2 and L3 can be disconnected from the call memories or storages 14, 15, 16 and 17. The NOR-gates 24, 25, 26 and 27 are arranged in such a fashion that their first inputs 24*a*, 25*a*, 26*a* and 27*a*, respectively, are connected by means of the call lines or conductors L0 to L3 with the outputs of the cabin and floor diode matrixes 6 and 12 and the outputs 24*c*, 25*c*, 26*c* and 27*c* of which are connected with the inputs 14*a*, 15*a*, 16*a* and 17*a* of the call memories or storages 14 to 17 (FIG. 1). A first NOR-gate 28, a NOT-gate 29 and a second NOR-gate 30 form a first series circuit, wherein the first NOR-gate circuit 28 and the second NOR-gate 30 each have two inputs 28*a*, 28*b* and 30*a*, 30*b*, respectively. The output 29*b* of the NOT-gate 29 is connected with the second inputs 24*b*, 25*b*, 26*b* and 27*b* of the NOR-gates 24, 25, 26 and 27, respectively, provided for the disconnection of the call lines L0 to L3, and the clock connection T of the position storage 20 (FIG. 1), whereas its input 29*a* is connected with the input 31*a* of a first transistor switch 31, the output 31*b* of which is connected with the input 32*a* of a second transistor switch 32 and by means of the supply line SPDC and the cabin call transmitters DC1 to DC15 with the inputs of the cabin diode matrix 6 (FIG. 1). The output 32*b* of the second transistor switch 32 is connected by means of the resistors 33, 34, 35 and 36 and the call lines L0 to L3 with the outputs of the cabin and floor diode matrixes 6 and 12. The output 30*c* of the second NOR-gate 30 of the first series circuit is connected with the input 37*a* of a third transistor switch 37, the output 37*b* of which is connected by means of a second supply line or conductor SPDE and the floor call transistors DE1 to DE15 with the inputs of the floor diode matrix 12 (FIG. 1). The output 100 of a second series circuit formed by a NOT-gate 38, a NOR-gate 39 having two inputs 39*a* and 39*b* and an OR-gate 40, likewise having two inputs 40*a* and 40*b*, is connected by means of the extinguishing line or conductor $\overline{SPGC}$ with the second inputs 14*b*, 15*b*, 16*b* and 17*c* of the call storages or memories 14, 15, 16 and 17, respectively (FIG. 1). The input 110 of the second series circuit is connected with input 120 of the first series circuit and a first input $\overline{GR\text{-}A}$ of the logic switching circuit 13, and the second input 39*b* of the NOR-gate 39 of the second series circuit is connected with the second input 130 of the first series circuit and a second input $\overline{ZFDC}$ of the logic switching circuit 13. A third input KB of the ligic switching circuit 13 is connected with the second input 40*b* of the OR-gate 40 of the second series circuit.

The transistor switches 31, 32 and 37, which are constructed according to known principles, have been symbolically illustrated, and the first and second transistor switches 31 and 32 each possess as essential elements two respective transistors 41, 42 and 43, 44, whereas there is provided a transistor 45 for the third transistor switch 37. By means of the transistor switches 31, 32 and 37 it is possible to alternately connect the supply or power lines SPDC, SPDE and the call lines L0 to L3 to the lines or conductors PO1, MO1. The line or conductor PO1 is connected with the positive terminal and the line MO1 with the negative terminal of a not further shown voltage source.

With the view of simplifying the explanation of the functional operation there is selected from the information derived from the drive control 3 and infed to the logic switching circuit 13 as input signals a minimum number as absolutely needed for understanding the function of the system and designated as follows:

$\overline{GR\text{-}A}=0$ Elevator cabin 2 is at standstill, no call is stored;

$\overline{ZFDC}=1$ Null to two seconds after stopping of the elevator cabin 2;

$KB=0$ Brake has dropped; and $\overline{RTS}=1$ Door open.

As is standard in the case of logic circuits the previously indicated numerals "1" and "0" designate the logic input and output states of the relevant switching elements. In the functional description to follow there thus likewise will be employed the designation, logic signal "1" or logic signal "0", an as will be apparent to those skilled in the art under these designations there can also be meant the presence and absence of voltage, respectively.

The previously described apparatus functions in the following manner:

When the elevator cabin or car 2 is at standstill, for instance, at the storey S1 and if it is assumed that the floor or chute doors T1 to T15 are closed, no call is stored. The input signals of the logic switching circuit 13 then, according to the above definition, can be defined as follows: $\overline{GR\text{-}A}=0$, $\overline{ZFDC}=0$ ($\leqq$two seconds after stopping of the elevator cabin 2), $KB=0$ and $\overline{RTS}=0$. In the presence of both input information or data $\overline{GR\text{-}A}=0$ and $\overline{ZFDC}=0$ there prevails the output information $\overline{SPDC}$ of the first NOR-gate 28 of the first series circuit.

Thereafter, the transistor 42 of the first transistor circuit 31 begins to conduct, so that the supply line SPDC is connected with the conductor MO1 and carries a logic signal "0". Since at the same time the transistor 43 is conductive, the output 32*b* of the second transistor switch 32 is connected with the line or conductor PO1 and carries the logic signal "1", so that the outputs of the cabin and floor diode matrixes 6 and 12 which are connected with the call lines or conductors L0 to L3 as well as the first inputs of the four NOR-gates 24 to 27 likewise carry the logic signal "1". This corresponds to the code word 1111 (FIG. 3, column II) present in binary inverted form and defining the message "No-Call". Since the output information SPDC 1 of the NOT-gate 29 of the first series circuit constitutes a logic "0" signal the outputs of the four NOR-gates 24 to 27 carry the logic signal "0", so that the code word 0000 (FIG. 3, column IV) appearing at the first inputs of the call memories or storages 14 to 17 and used for the call processing is defined as "No-Call".

With the information $\overline{GR\text{-}A}=0$ appearing at the input of the NOT-gate 38, the information or data $\overline{ZFDC}=0$ at the second input of the first NOR-gate 39 and the information $KB=0$ at the second input of the OR-gate 40 of the second series circuit, the output of this series circuit carries the logic signal "0". Hence, there appears by means of the extinguishing line $\overline{SPGC}$ the information $\overline{SPGC}=0$ at the second inputs of the call storages or memories 14 to 17.

Due to the input information SPDC $1=0$ and $\overline{RTS}=0$ of the second NOR-gate 30 of the first series circuit its output information is $\overline{SPDE}=1$. As a result, the transistor 45 of the third transistor switch 37 becomes conductive, so that supply line SPDE is connected with the line or conductor M01 and carries a logic signal "0".

During the input of a signal corresponding to a cabin call, for instance for the floor S14, the supply line SPDC carrying the logic signal "0" is connected with the relevant input of the cabin diode matrix 6, so that according to the number and arrangement of the diodes 22 the call lines L1, L2 and L3 likewise carry the logic signal "0", whereas the call line L0, still as previously, carries the logic signal "1" (FIG. 2). This corresponds to the code word 0001 present in binary inverted form and defining the message "Floor S14", as best seen by referring to FIG. 3, column II. The outputs of the four NOR-gates 24 to 27 thus carry the logic signals "1", "1", "1", "0", so that the code word 1110 appearing at the first inputs of the call storages or memories 14 to 17 and employed for the call processing represents "Floor S14", as best seen by referring to FIG. 3, column IV. Since in the meantime the information $\overline{SPGC}$, appearing at the second inputs of the call storages 14 to 17, has changed from a logic signal "0" to a logic signal "1", the infed cabin call is stored and delivered to the inputs A0 to A3 of the comparator 18.

There can be assumed that only a single cabin call appears at any given time, since the cabin call transmitters DC1 to DC15 are connected in series. With simultaneous infeed of a number of cabin calls there is thus only taken into account that cabin call which has been infed by means of the cabin call transmitter DC1 to DC15 which is situated closest to the supply SPDC.

After the call input, during the beginning of travel of the elevator car or cabin 2, there prevails the following input signals of the logic switching circuit 13: $\overline{GR\text{-}A}=1$, $\overline{ZFDC}=0$, KB=1 and $\overline{RTS}=0$. The output information $\overline{SPDC}$ of the NOR-gate 28 changes from the logic signal "1" to the logic signal "0". As a result, the transistor 42 of the first transistor switch 31 blocks, so that the supply line SPDC is connected by means of the transistor 41 with the conductor PO1 and carries the logic signal "1". Since at the same time the transistor 44 is conductive, the output of the second transistor switch 32 is connected with the conductor or line MO1 and carries the logic signal "0". Thus, in consideration of the poling of the diodes 22 of the diode matrixes 6 and 12 there is not possible any further cabin call input and, because of the outputs of the floor diode matrix 12 which are also connected with the call lines or conductors L0 to L3 there is also not possible any floor call input. Due to the change of the output information SPDC 1 of the NOT-gate 29 so as to carry the logic signal "1" the outputs of the four NOR-gates 24 to 27 again carry the logic signal "0", without the call storages 14 to 17 being influenced thereby, since in the meantime due to the condition $\overline{GR\text{-}A}=1$ and KB=1 the output information $\overline{SPGC}$ has changed to the logic signal "1".

During travel of the elevator cabin 2 the magnetic switches 7.0, 7.1, 7.2 and 7.3 are actuated by means of the switching magnets 9 which are secured in the elevator chute or shaft 1. Hence, the logic signal "1" of the supply line SPDC is switched by means of the magnetic switches 7.0, 7.1, 7.2 and 7.3 which are closed in accordance with the Gray-code (FIG. 3, column III) and the coupling device 10 at the call lines or conductors L0 to L3. The combination of the logic signals "1" and "0" representing the code words and characterizing the momentary cabin position, arrive by means of the call lines or conductors L0 to L3 at the code converter 19 where they are converted into the binary code (FIG. 3, column IV). The call storages 14 to 17 cannot be influenced by the cabin position signals, since they are disconnected from the call lines L0 to L3 by means of the four NOR-gates 24 to 27 having the input information SPDC 1=1. The clock connection T of the position storage 20 which is connected with the outputs of the code converter 19 likewise carries the information SPDC 1=1 (FIG. 1) which is present during travel of the elevator cabin, so that there is infed the cabin position signals to the inputs B0 to B3 of the comparator 18.

The comparator 18 now operates in such a manner that the code word appearing at the inputs A0 to A3 is compared with the code word appearing at the inputs B0 to B3. With the condition A0 A1 A2 A3>B0 B1 B2 B3 there is produced an "up"-signal, with the condition A0 A1 A2 A3 <B0 B1 B2 B3 a "down"-signal, and with the condition A0 A1 A2 A3=B0 B1 B2 B3 a "stop"-signal, which in each case is infed to the drive control 3. With the assumed example the code word 0001 associated with the floor S1 has a smaller value than the code word 1110 corresponding to the floor S14. The elevator cabin 2 thus travels upwards, and the code words appearing at the inputs B0 to B3 of the comparator 18 change from floor to floor (FIG. 3, column IV), until upon reaching the target floor (S14) and equality of the code words (1110=1110) the comparator 18 produces a stop signal and the elevator cabin 2 is brought to standstill.

Immediately after standstill of the elevator cabin 2 the information $\overline{ZFDC}$ briefly assumes the logic state "1", and this state is maintained for approximately two seconds by means of a not further illustrated but conventional timing or time-delay element, so that with KB=0 the information $\overline{SPGC}$ appearing at the output of the OR-gate 40 of the second series circuit switches from the logic state "1" to the logic state "0" and the call which has been stored in the call storages 14 to 17 is extinguished. As a result, there prevails the condition $\overline{GR\text{-}A}=0$ and since following approximately two seconds also $\overline{ZFDC}$ again assumes the logic state "0" there are again given the conditions for a call input.

The advantages realized with the invention particularly reside in the fact that for the transmission of the cabin and floor calls as well as the cabin position, and specifically, for the purpose of the control and the floor display, there can be beneficially utilized the same lines or conductors. Moreover, according to the equation $^2\log(N+1)=L$, with the floor number N=15 selected in the exemplary embodiment there are only required L=4 transmission lines plus 1 supply line both for the cabin call as well as for the cabin position. A further advantate resides from the use of the reflected or Gray-code for coding the cabin position. Since the Gray-code is one step, there is required for each floor change only one switching magnet and there do not occur any switching point differences, so that after an emergency stop there is available the correct cabin position. What is of further advantage is the use of bistable magnetic switches. As a result, the cabin position is maintained even with power failure, so that there is not required any correction travel.

Instead of connecting the floor display or indicator 21 with the position storage or memory 20 it can be directly connected with the call lines or conductors L0 to L3. It is also possible to install a floor display 21 in the elevator car or cabin 2, and such likewise can be directly connected with the call lines L0 to L3. In both cases the floor display 21 has its own position memory.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. An apparatus for transmitting control signals to a transportation system, such as an elevator having an elevator cabin travelling in an elevator cabin chute, comprising:

means for transmitting in coded form floor call and cabin call signals as well as cabin position signals;

storage means including call storages for storing the coded floor call signals and cabin call signals and a cabin position storage for storing cabin position signals;

a comparator for comparing the floor call signals and cabin call signals with the cabin position signals and for producing a respective control signal determinative of the direction of travel of the elevator cabin and the stop of such elevator cabin;

means for coding the floor call signals and cabin call signals;

said coding means comprising a respective cabin diode matrix and floor diode matrix each having outputs and inputs;

said call storages having inputs and outputs;

said transmitting means including common call lines for connecting the outputs of the diode matrixes with the inuts of the call storages;

a coding device for coding the cabin position signals;

said coding device comprising switches attached to the elevator cabin and actuation elements arranged in the elevator cabin chute;

the cabin position code comprising a Gray code;

one said actuation element being provided for each floor change;

each actuation element being associated with a changing binary place of the respective code word correlated to each floor;

coupling means having diodes;

each diode of the coupling means being connected in series with a respective one of the switches;

each said switch being connected by means of the therewith series connected diode of the coupling means with the outputs of the cabin diode matrix and by means of the call lines with inputs of the cabin position storage;

logic switching circuit means which, during travel of the elevator cabin and for a time span after stoppage of the elevator cabin, switch the diodes of the cabin and floor diode matrixes into the reverse direction and the diodes of the coupling means into the forward direction and disconnect the call lines from the call storages;

said logic switching circuit means during the remainder of the time of stoppage of the elevator cabin switching the diode matrixes into the forward direction and the diodes of the coupling means into the reverse direction and connecting the call lines with the call storages.

2. The apparatus as defined in claim 1, wherein:

said inputs of said call storages defining first and second inputs;

said logic switching circuit means comprises four NOR-gates each having two inputs;

said NOR-gates disconnecting the call lines from the call storages;

each said two inputs defining first and second inputs;

said first inputs of the NOR-gates being connected by means of the call lines with the outputs of the cabin and floor diode matrixes;

said NOR-gates having outputs connected with said first inputs of the call storages;

said logic switching circuit means further comprising a first series circuit of a first NOR-gate, a NOT-gate and a second NOR-gate and three transistor switches defining first, second and third transistor switches;

said NOT-gate having an output connected with the second inputs of the four NOR-gates disconnecting the call lines from the call storages;

said NOT-gate having an input connected with an input of the first transistor switch;

a first supply line;

said transmitting means including cabin call transmitter means and floor call transmitter means;

said first transistor switch having an output connected with an input of the second transistor switch and by means of said first supply line and said cabin call transmitter means being connected with the inputs of the cabin diode matrix;

said second transistor switch having an output;

resistance means for connecting the output of the second transistor switch and the call lines with the outputs of the cabin and floor diode matrixes;

an output of the second NOR-gate of the first series circuit being connected with an input of the third transistor switch;

said third transistor switch having an output;

a second supply line for connecting the output of the third transistor switch and the floor call transmitter means with the inputs of the floor diode matrix;

said logic switching circuit means having a second series circuit composed of a NOT-gate, a NOR-gate and an OR-gate;

said second series circuit having an output;

an extinguishing line for connecting the output of said second series circuit with said second inputs of the call storages and its input with an input of the first series circuit and a first input of the logic switching circuit means.

an input of the NOR-gate of the second series circuit being connected with a further input of the first series circuit and a second input of the logic switching circuit means; and a third input of the logic switching circuit means being connected with an input of the OR-gate.

3. The apparatus as defined in claim 1, wherein:

the switches attached to the elevator cabin comprise bistable magnetic switches; and said actuation elements mounted at the elevator cabin chute comprise switching magnets.

4. The apparatus as defined in claim 3, further including:

a floor display means controllable by means of the coded word formed by the bistable magnetic switches by means of the call lines serving for the transmission of the calls and the cabin position.

* * * * *